US006903334B1

(12) United States Patent
Makarov et al.

(10) Patent No.: US 6,903,334 B1
(45) Date of Patent: Jun. 7, 2005

(54) HIGH THROUGHPUT ION SOURCE FOR MALDI MASS SPECTROMETRY

(75) Inventors: Alexander A. Makarov, Cheshire (GB); Anatoli V. Verentchikov, St. Petersburg (RU)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 10/804,849

(22) Filed: Mar. 19, 2004

Related U.S. Application Data

(60) Provisional application No. 60/456,438, filed on Mar. 19, 2003.

(51) Int. Cl.[7] ..... H01J 49/04; H01J 49/16

(52) U.S. Cl. ..... 250/288; 250/281; 250/282; 250/287; 73/864.81

(58) Field of Search ..... 250/288, 287, 250/281, 282, 423 P, 424, 425; 73/864.81

(56) References Cited

U.S. PATENT DOCUMENTS 4,647,772 A * 3/1987 Lewis et al. ..... 250/288
5,087,815 A * 2/1992 Schultz et al. ..... 250/309
5,504,340 A * 4/1996 Mizumura et al. ..... 250/492.21
5,583,344 A * 12/1996 Mizumura et al. ..... 250/492.21
5,644,130 A * 7/1997 Raatz ..... 250/288
5,777,324 A 7/1998 Hillenkamp
5,825,035 A * 10/1998 Mizumura et al. ..... 250/423 R
6,111,251 A 8/2000 Hillenkamp
6,423,966 B2 7/2002 Hillenkamp
2002/0175278 A1 11/2002 Whitehouse
2003/0008404 A1 * 1/2003 Tomita et al. ..... 436/72

FOREIGN PATENT DOCUMENTS

WO WO 00/77822 A2 5/2000
WO WO 03/025973 A1 9/2002

* cited by examiner

*Primary Examiner*—John R. Lee
*Assistant Examiner*—Bernard E. Souw
(74) *Attorney, Agent, or Firm*—Fish & Richardson P.C.; Sharon Upham

(57) ABSTRACT

Mass spectrometers, ion sources and methods for providing and transporting analyte ions derived from a sample to ion optics. A sample chamber is configured to receive a sample plate supporting a sample, and an illumination source is configured to illuminate the sample to generate analyte ions and particles. A matrix-protecting interface is located between the sample plate and the ion optics, and configured such that the shortest travel path between the illuminated portion of the sample plate and the sampling aperture or input of the ion optics is substantially obstructed. Alternatively, a gas flow directed at an angle from zero to 90 degrees relative to the main axis of the ion optics and away from the ion optics influences particles generated by the action of the illumination source away from the ion optics, and a voltage source extracts analyte ions of interest.

50 Claims, 7 Drawing Sheets

HIGH THROUGHPUT ION SOURCE FOR MALDI MASS SPECTROMETRY

CROSS-REFERENCE TO RELATED APPLICATIONS

This application claims the benefit of Provisional Application No. 60/456,438, filed Mar. 19, 2003, which is incorporated by reference herein.

BACKGROUND

This invention relates to ion sources, and particularly to a Matrix Assisted Laser Desorption/Ionization ion source for use with an associated mass analyzer.

Different ion sources can be used in conjunction with mass analyzers. These include pulsed ion sources and continuous ion sources. Common examples of ion sources include the matrix assisted laser desorption ionization (MALDI) ion source and the surface enhanced desorption ionization (SELDI) ion source.

Matrix Assisted Laser Desorption/Ionization (MALDI) mass spectrometry is a useful technique for analysis of labile molecules, like proteins and nucleotides, and is widely employed in biochemistry and the life sciences. For a number of years, this ionization technique was used under purely vacuum conditions. Analyzed sample (analyte) is dissolved in a suitable matrix that absorbs in a selected UV wavelength range. The sample is deposited onto the sample plate, positioned in a vacuum chamber and irradiated by a pulsed laser, most commonly by a nitrogen laser at 337 nm. The matrix absorbs UV light, experiences rapid disintegration, and emits a microscopic plume of matrix vapors and a pulse of analyte ions. Conventionally, an ion plume extracted by a DC electric field and analyzed by a time-of-flight mass spectrometer. Recently, examples of MALDI using IR wavelengths have been described.

MALDI mass spectrometry was further improved with the introduction of the Delayed Extraction (DEMALDI) technique, in which a small delay of about 100 ns is incorporated between the laser pulse and the subsequent application of the extracting field. This substantially reduces collisions between analyte ions and matrix vapors and allows the extraction of molecular ions. With a proper choice of time delay and pulsed extracting field, the DE technique preserves pulsed properties of the ion plume and provides superior results. Nevertheless, the technique is still sensitive to sample preparation and requires searching for a sweet spot on a matrix crystal. The technique also requires fine tuning of laser energy near the threshold of ion production, depending on a particular crystal spot and, thus, can be difficult to automate for a high throughput mass spectrometric analysis, as is currently demanded by proteomics applications and single nucleotide polymorphism (SNP) screening.

With the introduction of MALDI at an intermediate gas pressure, ion source conditions were fully decoupled from mass analysis. In this technique, the MALDI ion source operates at a pressure in the range of 0.01 to 0.1 torr, and the ion beam is extracted into an RF-only ion guide. Collisions with neutral gas in the RF guide damp ion kinetic energy and convert ion pulses into a continuous or a quasi-continuous ion beam. The ion beam is subsequently analyzed by an orthogonal time-of-flight mass spectrometer (oa-TOF MS), again converting the ion beam into ion pulses, which are extracted orthogonal to the initial direction of the beam. In spite of the dual conversion between the pulsed and continuous beam, and in spite of associated ion loss, the technique appears to provide excellent sensitivity.

Damping by gas collisions was brought to the extreme by introduction of atmospheric pressure MALDI. In this technique, a single MALDI sample is positioned in the conventional electrospray interface in front of the nozzle, sampling ions into a differentially pumped interface. The sample is irradiated by a nitrogen laser, producing analyte ions. Ions are extracted by a strong electric field and are blown from the sample by a gas jet. All these means are necessary to suppress cluster formation with matrix molecules. Even so, cluster-formation severely limits merits of the technique, and so far the method has only been applied to peptide samples with a single matrix—alpha-cyano-hydrocinnamic acid. Operation at atmospheric pressure seems to be convenient, since the samples can be changed without loading into a vacuum chamber. However, in a high throughput ion source, sample loading time becomes negligible compared to analysis time, since sample plates accommodate from 100 to 400 samples. In addition, ion extraction at atmospheric pressure is accompanied by severe ion losses which limit sensitivity. Considering the sacrifice in performance, atmospheric pressure MALDI appears less practical than MALDI at intermediate gas pressure.

Looking at a wider range of operating conditions, Verentchikov et al. (WO 00/77822 A2) have found that MALDI at intermediate gas pressure provides substantially better results at gas pressures between 0.1 and 1 torr. Gas collisions at such pressure rapidly cool ion internal energy and allow soft ionization in a wide range of laser energy. Further increase in gas pressure is limited by formation of ion clusters with matrix molecules. At pressures up to about 1 torr, gas heating the RF ion guide to about 200° C. can resolve this problem. At higher gas pressures, however, cluster formation becomes so abundant that at any harsh conditions in the interface it is more likely to fragment ions than to clear them out of cluster shell.

Collisional cooling of internal energy allows using laser energy about three to five times higher than the threshold of ion production, which enhances ion intensity by several orders of magnitude. The technique is also compatible with high repetition rate lasers at a kilohertz range. As a result, ion intensity in MALDI at intermediate gas pressure can be several orders of magnitude higher than in DE MALDI the latter being compatible with high repetition rate lasers because of technical difficulties associated with high repetition rate of the extraction pulse. High signal intensity in MALDI with collisional cooling allows rapid analysis—a desirable feature in proteomics and SNP applications. Ease of automation makes the technique particularly suitable for high throughput analysis. However, using high intensity ion beam creates a new problem contamination of the source electrodes by matrix vapors emitted due to the high repetition rate of the laser pulses at elevated energy. At a rate of screening of 1 to 10 samples per second, approximately 1 mg/s of matrix is emitted from the sample plate and deposited on the source electrodes. Some of that material is emitted as hot matrix vapors and some as small droplets or clusters. Matrix layers deposit to form dielectric films. Charging of those films by the ion beam distorts the electric fields and eventually repels the ion beam. Heating of the front electrodes and the RF ion guide as in Verentchikov et al. (WO 00/77822 A2) merely leads to matrix deposition onto subsequent electrodes of the transport interface and mass spectrometer.

Similar problems of interface protection have been addressed in applications using the electrospray (ESI) technique. In that technique, a sample, dissolved in a solvent, is pumped through a small-bore capillary into an ion source that is filled with a gas at atmospheric pressure. Applying a few kilovolts to the capillary atomizes the solvent into a fine aerosol. The charged aerosol evaporates solvent and produces a mixture of vapors, micro-droplets, and ions of the sample. Ions are sampled into a nozzle and transported into the vacuum chamber of a mass spectrometer via a differentially pumped interface. If no protection is used, the salts and buffers from real pharmaceutical samples quickly clog the interface.

In the so-called 'ion spray' technique, nebulization is assisted by a coaxial gas jet. The jet entrains the aerosol and directs it at a spot displaced from the nozzle entrance. Ions are attracted towards the nozzle by an electric field and travel across the gas jet faster than charged droplets. By adjusting the spray position, source clogging can be reduced with limited reduction in signal intensity. Interface ruggedness is also improved with the introduction of so-called 'curtain gas' devices. In these devices, an additional annular electrode is installed in front of the sampling nozzle. Gas is introduced between the nozzle and the electrode, and flows through the electrode aperture towards the spray capillary, repelling vapors and small droplets. An electric field between the spray capillary, electrode, and nozzle assists ion extraction through the gas counter flow.

In the so-called Z-spray and M-spray interfaces, interface ruggedness is further improved by providing a bent channel so that direct carryover of droplets is impeded while ion transport is facilitated by a combination of gas flows and electric fields. Such systems can be used for high flow rates of solvent, up to 2 mL/min.

SUMMARY

The invention provides methods and apparatus, including ion sources and mass spectrometers incorporating such ion sources, for high throughput mass analysis. The methods and apparatus, some of which are particularly applicable for applications in the area of genomics and proteomics, are based on MALDI at intermediate gas pressure with a high repetition rate and high-energy laser beam. The proposed apparatus incorporates matrix-protecting interfaces configured so that the shortest travel path between an illuminated portion of the sample plate and the input to ion optics, or an ion sampling aperture, is substantially obstructed and/or so that contaminating particles are repelled away from the matrix-protecting interface, e.g., by gas flow, while an electric field extracts analyte ions of interest.

The invention is based in part on the discovery that the optimum gas pressure in the MALDI ion source, known to be around 1 torr, is also sufficient to prevent matrix deposition by a properly formed gas flow, while ions can be sampled into a transport interface by a constant (DC) electric field. A number of possible schemes of matrix-protected interface can be used, including a counter-flow scheme, orthogonal flow scheme, and zig-zag channel scheme. In some embodiments, operating at even higher gas pressure can be advantageous for soft ionization and efficiency of the ion sampling in a matrix-protected interface. A UV light in the range from 300 to 360 nm can be used to overcome cluster formation in the ion source, which is typical at gas pressure above 1 torr, by illuminating cluster ions along their path in the ion source.

In general, in one aspect, the invention features ion sources suitable for use in MALDI mass spectrometry. The ion sources can include a source of analyte and matrix ions, ion optics, and a matrix-protecting interface located between the source of ions and the ion optics. In alternative embodiments, the ion optics does not form part of the ion source and can be disposed for example at the output end of the ion source, at the mass analyzer, or at any subsequently placed device.

Particular embodiments can include one or more of the following features. The source of ions can include a sample chamber and a pulsed UV laser configured to illuminate samples in the sample chamber. The sample chamber can be configured to contain a sample plate on which samples, mixed in suitable MALDI matrices, can be deposited. The sample chamber can be pressurized with a gas at a pressure of around 1 torr. The matrix-protecting interface can include one or more apertures, gas channels, gas leaks, pumps, and/or DC power supplies, attached to electrodes.

The shape of electrodes, path(s) of gas flow, pressure regimes, and applied potentials of matrix-protecting interfaces can be selected to ensure repelling of matrix vapors and other such contaminating particles and effective ion extraction by DC electric field. In some matrix-protecting interfaces, the pumping speed of pumps and mass flow of gas supplies are selected to provide gas flow slower than $V<100$ m/s and gas pressure P in the sample chamber around 1 torr, which is an optimum gas pressure for ion production. The distance L between the sample plate and the matrix-protecting interface can be chosen to satisfy $P*L>2$ mm*torr to provide for enhanced repelling of matrix vapors and small matrix clusters. A DC potential U between the sample plate and the matrix-protecting interface can be adjusted above $U>VL/K$, where K is pressure dependent ion mobility, approximately equal to 0.1 $m^2/Vs$ at 1 torr gas pressure, to provide for ion extraction out of the gas flow. A higher potential can be applied to provide for additional declustering of ions.

In one embodiment, called here 'counter-flow', the matrix-protecting interface comprises a single electrode with an aperture, separating the sample and ion optics chambers. A gas supply feeds the gas into the ion optics chamber, thus producing a gas counter flow for repelling matrix droplets, gasses, and other such contaminating particles. Analyte ions are extracted by electric field through the gas counter flow and into the ion optics.

In another embodiment, called here 'curtain gas', the matrix-protecting interface comprises two curtain electrodes with apertures, introduced between the sample plate and the ion optics. A controlled gas leak introduced between the curtain electrodes forms a gas counter flow with a small portion of the gas going into the ion optics. The small size of the second aperture and the large pumping speed in the ion optics area provide a pressure in the ion optics area below 0.1 torr, which allows a wider range of RF signal amplitudes. A DC field between the curtain electrodes provides ion focusing through a small aperture.

In still another embodiment, called here 'side jet', the matrix-protecting interface comprises a tube, oriented parallel to the sample plate. Gas fed through the tube forms a jet parallel to the sample plate. Matrix vapors are blown away from the illuminated portion of the sample plate by the gas jet. The extracting electrode with a skimmer (e.g., a cone with a sampling aperture at the tip), positioned downstream from the illuminated portion of the sample plate extracts ions by an adjustable DC electric field.

In another embodiment, called here 'S-flow', the matrix-protecting interface comprises a heated block with a curved channel, as well as an extracting skimmer on the side of the channel. A pump evacuates the channel from the back end, inducing gas flow from the sample chamber, sucking in matrix vapors and analyte ions. Ions are extracted by electric field out of the gas flow via a skimmer and into the ion optics. Larger droplets, possibly emitted from the sample plate, can not follow the non-linear flow and will be deposited onto the walls of the channel. With the aid of heat, matrix material slowly evaporates and is pumped away.

The above-described matrix-protecting interfaces can be operated at a higher gas pressure of 3 to 10 torr in order to protect the matrix-protecting interface from matrix micro drops. To strip matrix molecules from ion clusters, typical at such gas pressures, UV light of wavelength from 300 to 360 nm illuminates cluster ions along their path in the ion source. A nitrogen bulb with an optical filter and focusing reflector can be used as a source of UV light. A laser can also be used for declustering purposes as well. The laser beam can be introduced through and on the main axis of the ion optics. A parallel laser beam of ~0.5 mm diameter from a Nd-YAG laser can provide sufficient energy density for ion production and at the same time illuminates the ion flow during ion transport in the transfer optics. Ions are confined on the main axis of the guide by RF field assisted by collisional damping. By using a high energy and high repetition rate laser, ion clusters have a high probability of selectively absorbing UV light and being fragmented. Fairly high gas pressure in the ion optics from 0.1 to 10 torr provides for collisional cooling of ions internal energy. The amount of matrix material removed from clusters is many orders of magnitude lower than the matrix material emitted from the sample plate and will contribute little to matrix-interface contamination.

Particular embodiments can provide one or more of the following advantages. The ion sources can produce an intense ion beam which is suitable for rapid analysis, thus allowing efficient screening of multiple samples. The matrix-protecting interfaces incorporated in the ion sources provide protection against matrix vapors, small matrix clusters, and other contaminating particles, adding to ion source longevity. A gas pressure of about 1 torr, which is an optimal pressure for ion production, is sufficient to employ matrix-protecting interfaces similar to those used in electrospray ion sources. A higher gas pressure (e.g., about 10 torr) can be used in the area of ion production, thus improving ion cooling and cluster repelling in the matrix-protecting interface. The problem of ion cluster formation, typical at elevated gas pressure, can be resolved by introducing a UV light that is absorbed by matrix molecules only, illuminating cluster ions along their path in the ion source. Cluster removal leaves ions intact since minor excitation of ions internal energy is cooled in gas collisions within the source.

The details of one or more embodiments of the invention are set forth in the accompanying drawings and the description below. The figures are not to scale, and in particular, certain dimensions may be exaggerated for clarity of presentation. Further features, aspects, and advantages of the invention will be apparent from the description and drawings, and from the claims.

DESCRIPTION OF DRAWINGS

Like reference symbols in the various drawings indicate like elements.

DETAILED DESCRIPTION

Before describing the invention in detail, it must be noted that unless otherwise defined, all technical and scientific terms used herein have the meaning commonly understood by one of ordinary skill in the art to which this invention belongs. In case of conflict, the present specification, including definitions, will control. All publications, patent applications, patents, and other references mentioned herein are incorporated by reference in their entirety. Unless otherwise noted, the terms "include", "includes" and "including", and "comprise", "comprises" and "comprising" are used in an open-ended sense—that is, to indicate that the "included" or "comprised" subject matter is or can be a part or component of a larger aggregate or group, without excluding the presence of other parts or components of the aggregate or group.

Figure 1:
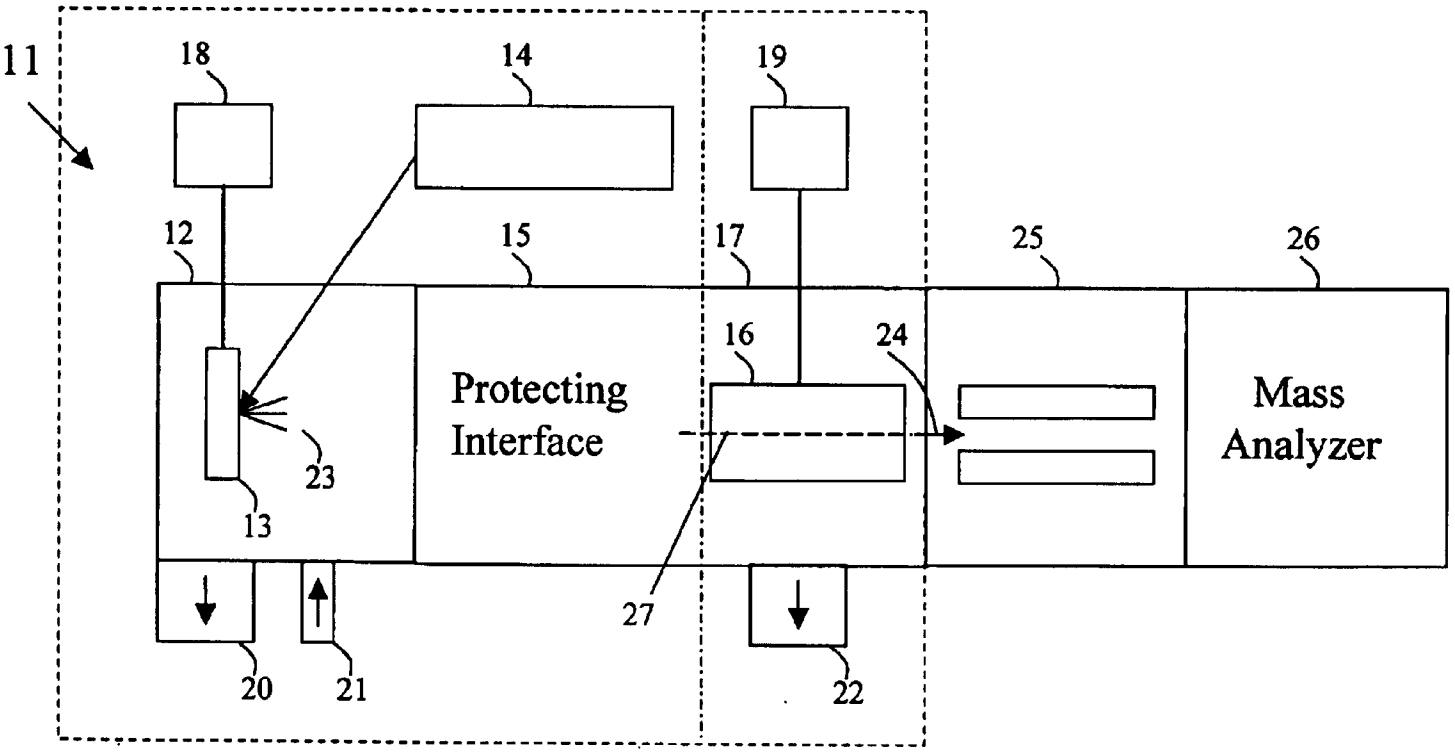
FIG. 1 is a block diagram illustrating one embodiment of a matrix protected MALDI ion source at intermediate gas pressure according to one aspect of the invention, applied for mass spectrometric analysis.

As illustrated in FIG. 1, an ion source 11 of the present invention can be used to reduce the contaminating particles that may be transferred to the ion optics 16 associated with a mass analyzer 26, thereby optimizing the ratio of analyte ions to other particles entering the mass analyzer. The ion source 11 according to one aspect of the invention comprises a sample chamber 12, containing a sample plate 13, an illumination source 14, ion optics 16, surrounded by an ion optics chamber 17, and a matrix-protecting interface 15, which connects the sample chamber 12 with the ion optics 16. The ion optics has a main axis 27. DC Potentials of sample plate 13 and ion optics 16 are controlled by power supplies 18 and 19, respectively. The sample chamber 12 is evacuated by a pump 20 and gas pressure in the sample chamber 12 is adjusted by a gas supply 21. The ion optics chamber 17 is evacuated by a pump 22. In particular embodiments, the matrix-protecting interface 15 can include a variety of electrodes, gas channels, gas supplies, vacuum pumps and power supplies, as will be described and illustrated in more detail below. As illustrated in FIG. 1, the ion optics 16 can form part of the ion source 11. Alternatively, the ion optics can comprise a discrete component disposed for example at the output end of the matrix-protecting interface 15, or forming for example a part of the mass analysis system or mass spectrometer.

In operation, a sample of analyzed material is mixed with a solution of suitable MALDI matrix, and the solution is deposited onto the sample plate 13. The sample is dried in atmosphere or under controlled conditions of atmosphere and temperature and the sample plate 13 is inserted into a sample chamber 12, which is filled with a gas, such as nitrogen, at gas pressure around 1 torr. The illumination source 14 can comprise, for example, a pulsed UV laser, such as a nitrogen laser at 337 nm or Nd:YAG laser at 355 nm wave length, and illuminates at least a portion of the sample on the sample plate 13 at an energy density above the threshold of ion production (e.g., estimated to be around 30 $mJ/cm^2$ at an average 3 ns laser pulse duration). The illumination source 14 rapidly heats a thin layer of matrix on the sample plate 13 and produces an eruption of matrix from the illuminated portion of the sample plate 13. Matrix plume 23 contains analyte ions and other particles including matrix vapors, small crystals and ions of matrix. Internally excited ions are chilled and stabilized in gas collisions and drift towards the matrix-protecting interface 15 by means of inertia, electric field, and/or gas flow.

In general, in one aspect of the invention, the matrix-protecting interface 15 is configured such that if the analyte ions and other particles were to travel along the shortest path between the illuminated portion of the sample plate and the input of the ion optics 16, the analyte ions and other particles would be substantially obstructed from doing so by a portion of the matrix-protecting interface 15. The matrix-protecting interface 15 can be configured for example such that the shortest path between the illuminated portion of the sample plate and a sampling aperture, typically but not necessarily aligned with the main axis of the ion optics (not shown here, but described in more detail below) and through which the ions exit the matrix-protecting interface 15, is substantially obstructed. In this aspect, there is effectively no line of sight between the illuminated portion of the sample plate and the sampling aperture, along which these particles can pass through the matrix-protection interface 15 to enter the ion optics 16. In general, in another aspect of the invention, the analyte ions and other particles are separated within gas jets and an electric field is formed in the matrix-protecting interface 15. Matrix, small droplets, and other contaminating particles are blown away by the gas flow, while analyte ions of interest are extracted into the ion optics 16 by the electric field. Particular details of several embodiments of matrix-protecting interfaces are described below.

Sample ions are transported through the ion optics 16, forming an output ion beam 24. The ion optics 16 is shown as an ion guide, a radio frequency multi-electrode device that can be of any known kind, including multipoles such as quadrupoles, or multi-plate guides such as ion funnel devices, tube lenses, "ion tunnels" comprising a plurality of RF electrodes having apertures through which ions are transmitted, aperture plate lenses or differential pumping, but any suitable ion optics can be used. The ion optics 16 can use a gradient of axial DC potential to assist rapid ion transfer through the ion optics 16 and can also have DC voltages applied so as to act as a mass filter. The voltage and frequency to be applied to the ion optics on the top of the DC potential depends on gas pressure regime.

Again referring to FIG. 1, the methods and ion sources of the invention can be applied in the field of mass spectrometry. As shown in FIG. 1, the ion source 11 is connected to a mass analyzer 26 via adapting ion optics 25. The adapting ion optics 25 may contain several differentially pumped stages with an ion transporting device; such as RF multipole ion guides. Gas pressure in the adapting ion optics 25 will typically range between 0.01 to 0.1 torr, and gas pressure in mass spectrometer is typically maintained below $10^{-5}$ torr. The mass analyzer 26 can be a single stage mass analyzer, such as a time-of-flight mass spectrometer with an orthogonal ion injection (oa-TOF), ion trap (IT), linear ion trap (LIT), ion cyclotron resonance (ICR), orbitrap or FTMS; or a dual stage mass analyzers, such as a quadrupole/oa-TOF, LIT-TOF, LIT-orbitrap, Quadrupole-ICR, IT-ICR, LIT-oa-TOF, or LIT-orbitrap mass analyzer.

Although as illustrated and described, the ion optics 16 are shown to be confined to one pressure region, an ion optics device may stretch over or otherwise encompass two or more pressure regions.

To understand operation of matrix-protecting interfaces at a gas pressure about 1 torr, one needs an understanding of relevant processes involved. A matrix plume emitted by the laser accelerates analyte ions, vapors, small matrix drops, and other such particles to approximately 500 m/s. In a short distance from the sample plate (e.g., less than 0.1 mm), the plume density is low enough to neglect collisions, and emitted material travels by inertia and experiences collisions with gas that fills the sample chamber. Eventually, gas collisions adjust the velocity of emitted material to the velocity of a slow gas flow.

The balance between inertia and gas friction can be described by the number of collisions, or path length, necessary for velocity relaxation. For matrix molecules with typical molecular weight of about M=200 Dalton and considering nitrogen as a bath gas with molecular weight of m=28 Dalton, velocity relaxation takes approximately N~M/m=7 collisions. At gas pressure of 1 torr the gas density is $n=3*10^{16}$ cm-3 and the relaxation path of a matrix molecule with a cross section of $s=3*10^{-15}$ $cm^2$ is in the order of 1=M/(m'n's)=0.7 mm. Thus, a gas flow with characteristic length exceeding a few millimeters will be expected to relax the matrix velocity. Any smooth flow, where gas velocity does not change rapidly, will entrain matrix molecules and, in reverse, any flow with sudden changes in direction or gradients, where velocity changes on a scale shorter than 1 mm, has a good chance of spinning off matrix molecules. Since gas density is pressure dependent, the boundary between inertia regime and entrained flow is better described by the product of pressure P and typical length L of the flow: for matrix molecules it is (P*L)·0.7 mm*torr. In the embodiments described below, the gas flow should be smooth enough to entrain matrix molecules in order to carry away vapors.

Larger particles, such as matrix clusters, require a larger relaxation length, depending on number N of matrix molecules in a cluster. The cross section a of a cluster is proportional to $N_{2/3}$, while the cluster mass M is proportional to N. Thus, relaxation length $\lambda=M/(mn\sigma)$ is proportional to $N^{1/3}$. For example, cluster with $N\sim3*10^3$ molecules has $\lambda=1$ cm at 1 torr, i.e. (P*L)=1 cm*torr. Size distribution of emitted clusters is not known yet and may depend on laser energy. However, one may assume the upper size to be compatible with a depth of illuminated matrix layer $D\sim5*10^{-8}$ m. Such a chunk of crystal would include approximately $N=10^6$ matrix molecules and relaxation length would be $\lambda\sim10$ cm at a gas pressure P=1 torr. In the majority of matrix-protecting interfaces described herein, a cluster size under N<1000 is assumed, which can be entrained by a gas flow with (P*L)~2 cm*torr. In one particular embodiment with coaxial introduction of laser beam, the matrix-protecting interface operates at a higher gas pressure, protecting against larger matrix clusters.

Contrary to neutral particles, analyte ions have an order of magnitude higher cross section, and thus, in spite of larger mass, ions relax their kinetic energy faster. In typical applications, the ion mass is expected to be less than 10,000 Dalton, corresponding to cluster size N=50, such that ion inertia is negligible and ions are entrained in a gas flow with (P*L)~2 cm*torr. In the methods and ion sources described herein, analyte ions are extracted through the gas flow by an electric field. Ion velocity is a vector sum of gas velocity $V_g$ and drift velocity $V_e$ defined by ion mobility K: $V_e=KE$, where E is the strength of the electric field. At a gas pressure of 1 torr, the mobility of small ions is K~0.2 $m^2$/sV. Mobility of larger ions is a weak function of ion size and is approximately K>0.04 $m^2$/Vs for ions up to 2,000 Daltons. To calculate the electric field as $E>V_g/K$ one needs a value of gas velocity. The velocity of nitrogen flow does not exceed 800 m/s even for a supersonic jet. Thus, at 1 torr gas pressure, an electric field of 200V/cm is sufficient to extract ions through the gas counter flow. However, dragging an ion at such velocity increases its internal energy and may cause ion fragmentation. Using a high electric field implies a limit on the distance between electrodes, since electric discharge is likely to occur at voltage differences above 300V. It may be more practical to organize a slower gas counter flow with velocity comparable to, and possibly less than, the speed of thermal motion (~300 m/s). Limiting the gas velocity makes extraction by the electric field softer and helps prevent electric discharges. A higher electric field can be applied to cause ion fragmentation if needed for analytical purposes.

Figure 2:
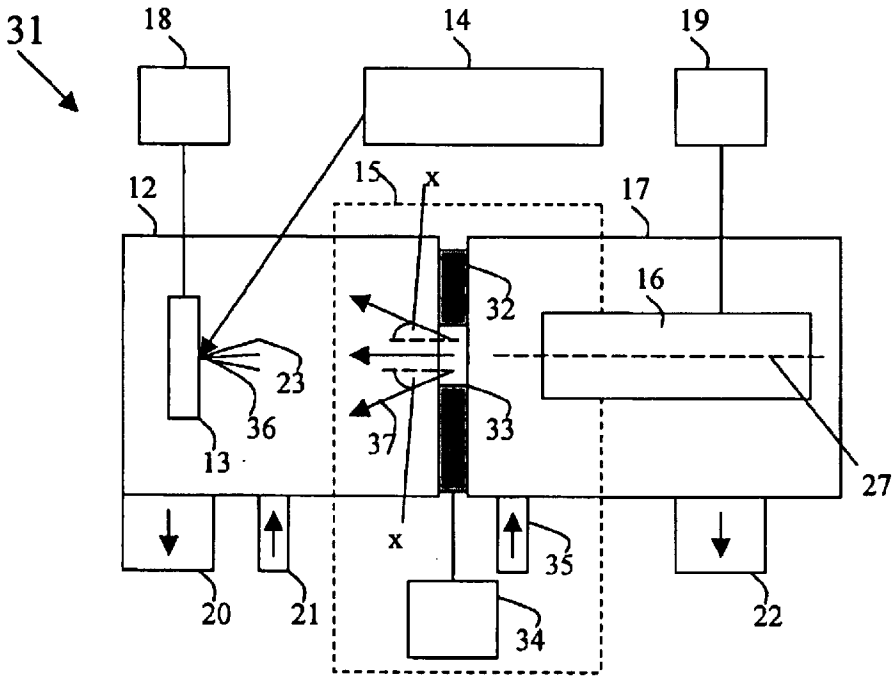
FIG. 2 is a schematic drawing illustrating one embodiment of an ion source according to one aspect of the invention, incorporating a gas counter flow.

Referring to FIG. 2, one embodiment of an ion source 31 includes a sample chamber 12 with the sample plate 13, laser 14, matrix-protecting interface 15, and ion optics 16 contained in an ion optics chamber, power supplies 18 and 19 controlling DC potentials of electrodes, pumps 20 and 22, and gas supply 21. In this embodiment, the matrix-protecting interface 15 comprises an annular electrode 32 with an aperture 33 and a DC power supply 34 attached to the electrode 32, and a gas supply 35 from which gas can be fed into the ion optics chamber. Aperture 33 connects the sample chamber 12 with the ion optics chamber and is aligned with the illuminated portion 36 on the sample plate 13.

In operation, the matrix-protecting interface 15 forms a gas counter-flow 37 through the aperture 33 and into the sample chamber 12. The counter-flow 37 is directed towards the sample plate 13. In this embodiment, components of the gas flow, as represented by the counter gas flow arrows 37, are directed at an angle x relative to the main axis 27 of the ion optics 16, and are directed away from the ion optics 16, and towards the sample plate 13. The pumping speed of the pump 20 is selected or adjusted to provide for a velocity $V_g$ of counter gas flow below 300 m/s, in some embodiments below 100 m/s. The gas supply 34 can be adjusted to provide about 1 torr gas pressure P in the sample chamber 12, which is optimal for ion production. Both gas pressure in the chamber 12 and velocity of gas flow 37 can be fine-adjusted by a gas supply 21. Gas supplies can include a controlled leak from ambient air or a gas bottle of dry air, nitrogen, argon or any other suitable gas. Distance L between the sample plate 13 and the annular electrode 32 is chosen to satisfy P*L>2 mm*torr to provide for repelling of matrix vapors, small matrix clusters, and other such contaminating particles. A DC potential U between sample plate 13 and the electrode 32, controlled by power supplies 18 and 34, is selected to be greater than or equal to VL/K to provide for ion extraction through the counter-flow 37, where K is ion mobility. For typical numbers of P=1 torr, L=2 cm and $V_g$=100 m/s, the ion mobility of ions of interest is considered to be K>0.04 $m^2$/Vs and an electric field of E>2500V/m should be sufficient for ion extraction, which corresponds to potential difference U>50V. A higher potential can be applied to provide an additional declustering of ions or ion fragmentation for analytical purposes. Once ions pass through the aperture 33, a DC field between the annular electrode 32 and the ion optics 16 transfers analyte ions of interest into the ion optics 16. The ion optics 16 can be for example any known ion guide device capable of confining an ion beam to the axis of the device by a radio frequency electric field. The amplitude of RF electric potential, applied to electrodes of the guide is limited below 300V because of a gas pressure range, favorable for electric discharges. Note that the requirement of a slow gas flow (V<100 m/s) links gas pressure in the ion optics chamber 17 with the pressure in the sample chamber 12, which is adjusted to about 1 torr to optimize ion formation and to provide sufficient number of collisions in the jet for vapors entraining. It has been demonstrated that an RF ion guide remains an efficient transporting device at gas pressure around 1 torr, once the frequency of RF field is adjusted according to desired mass range of transported ions.

Figure 3:
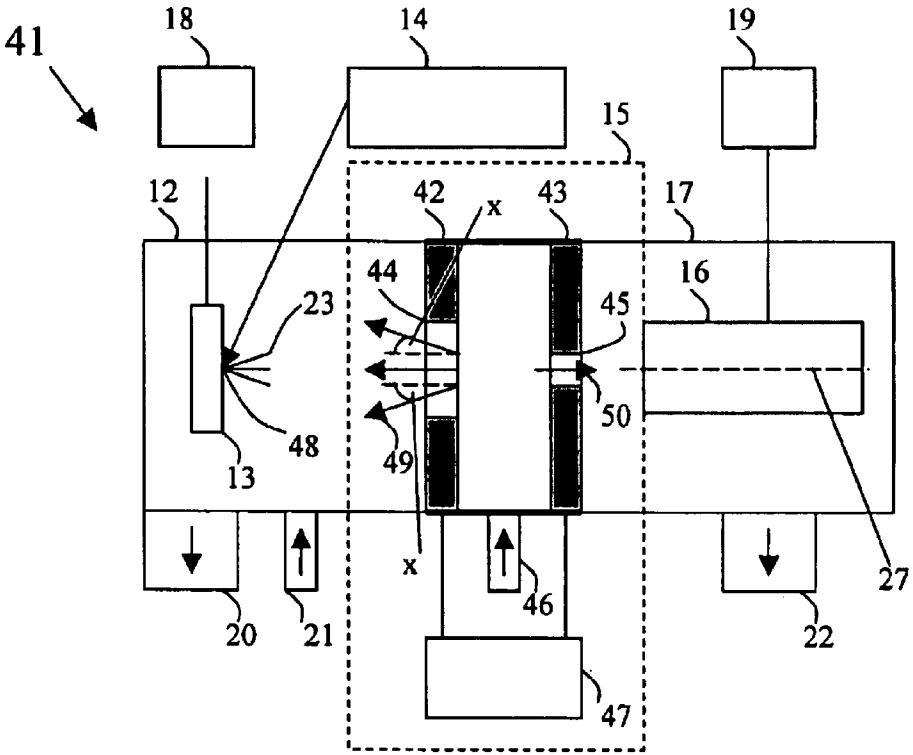
FIG. 3 is a schematic drawing illustrating an embodiment of an ion source according to one aspect of the invention, incorporating a curtain gas counter flow.

Referring to FIG. 3, another embodiment (called here 'curtain gas') of an ion source 41 includes a matrix-protecting interface 15 that comprises two curtain electrodes 42 and 43 with apertures 44 and 45 and a gas supply 46 supplying gas in-between. The curtain electrodes 42, 43 can have a variety of shapes, such as a shape of a plate or a shape of a cone, and can be coupled to a set of DC power supplies 47. Coaxial apertures 44 and 45 are aligned with the illuminated portion 48 of the sample plate 13 and connect sample chamber 12 with the ion optics chamber 17.

In operation, the matrix-protecting interface 15 forms a gas flow 49, wherein at least a component of the gas flow is directed at an angle x relative to the main axis 27 of the ion optics 16, moves from the aperture 44 in the first plate 42 towards the sample plate 13 and away from the ion transfer optic 16. The gas is supplied by a gas supply 46 and is pumped by pumps 20 and 22. Referring to FIG. 3, a small portion 50 of the gas supplied by gas supply 46 comes through a second, smaller aperture 45 in a second plate 43. Similar to the previous embodiment, the pumping speed in the sample area, the mass flow of the gas supply, as well as the potential difference U and distance L between sample plate 13 and the first plate 42 can be adjusted to provide $V_g$<100 m/s, P~1 torr, P*L>2 mm*torr and U>VL/K. The small size of the second aperture 45 and the large pumping speed of pump 22 provide a pressure in the ion optics 16 area well below 0.1 torr to allow wider range of RF signal amplitudes. A DC field between 'curtain' cones 42 and 43, controlled by a set of DC power supplies 47 can provide ion focusing through a small aperture 45.

Figure 4:
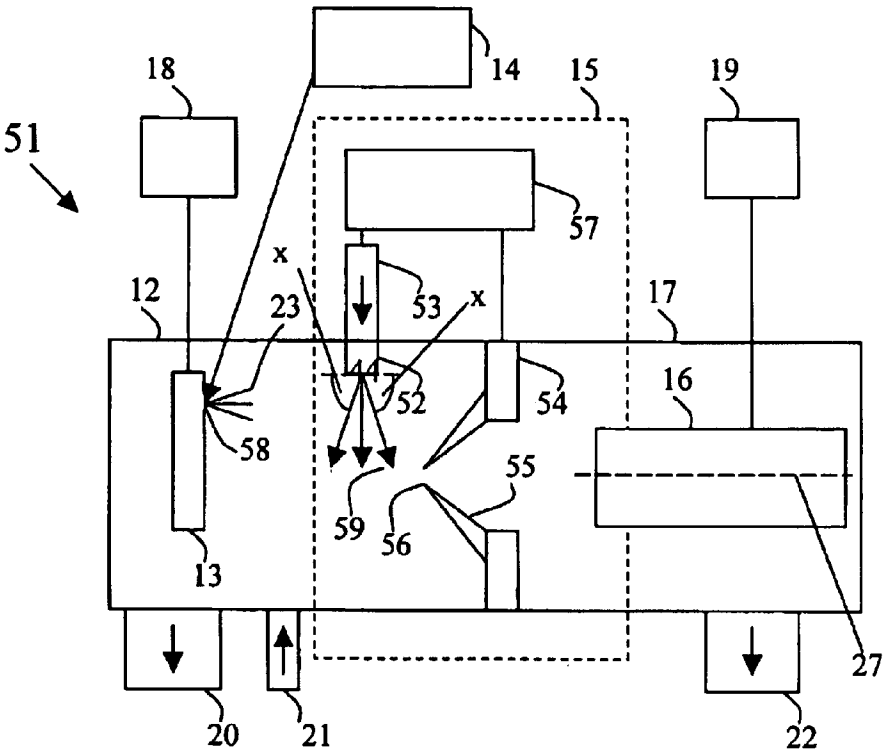
FIG. 4 is a schematic drawing illustrating an embodiment of an ion source according to one aspect of the invention, incorporating an orthogonal gas jet.

Referring to FIG. 4, still another embodiment (called here 'side jet') of an ion source 51 includes a matrix-protecting interface 15 that comprises a tube 52 connected to a gas supply 53 and an electrode 54 with a skimmer 55 (i.e. a cone with a sampling aperture 56 on its tip). A set of DC power supplies 57 controls DC potentials of the tube 52 and the electrode 54. The electrode 54 can be a part of the ion optics chamber 17. The ion optics 16 can be aligned with the sampling aperture 56.

In operation, the matrix-protecting interface 15 forms a gas flow 59 coming out of the tube 52, wherein the flow is not aligned with the axis 27 of the ion optics 16 and is also not primarily directed towards the sample plate 13. In this example, the tube 52 is oriented substantially parallel to the sample plate 13, so that a gas flow 59 blows substantially parallel to the sample plate 13, substantially orthogonal to the axis of the ion optics 16, and above the illuminated portion 58 of the sample plate 13. Sampling aperture 56 is located downstream of the illuminated portion of sample on the sample plate 13. Matrix vapors and other contaminating particles entrained into the gas flow 59 at some distance from the sample plate 13 are blown towards the side walls of the sample chamber 12, not passing the electrode 54. Hot matrix vapors precipitate on the surface of the sample chamber 12, which is held at room temperature. In this manner, deposited film stays away from the desired ion path, the path from the illuminated portion of the sample plate 13 to the ion optics 16, and does not disturb operation of the ion source 51.

Mass flow through the tube 52 and the pumping speed of pump 20 can be adjusted to provide gas pressure P in the sample chamber around 1 torr for collisional cooling of MALDI ions. The pressure can be fine adjusted by a gas supply 21. The distance L between sample plate 13 and the tip of electrode 54 can be selected as P*L>2 mm*torr to provide a sufficient number of gas collisions entraining matrix vapors into the jet. The DC field between sample plate 13, tube 52, and electrode 54 can be controlled by DC power supplies 57, and can be adjusted to provide for analyte ion extraction through the sampling aperture 56 and into the ion optics 16. The effect of electric field focusing on the tip of the cone improves ion focusing into the tip of the cone as well as analyte ion extraction through the sampling aperture 56. Since ions are separated by their mobility, the mass range of extracted analyte ions will be limited to some extent. The mass range of interest can be selected by adjusting the velocity of gas flow and/or strength of the electric field in the source. Mass discrimination, however, is not expected to impede analytical performance of the source. Similar types of analyte ion extraction are employed in various earlier described electrospray ion sources, where mass discrimination has not been reported as a limiting factor.

Figure 5:
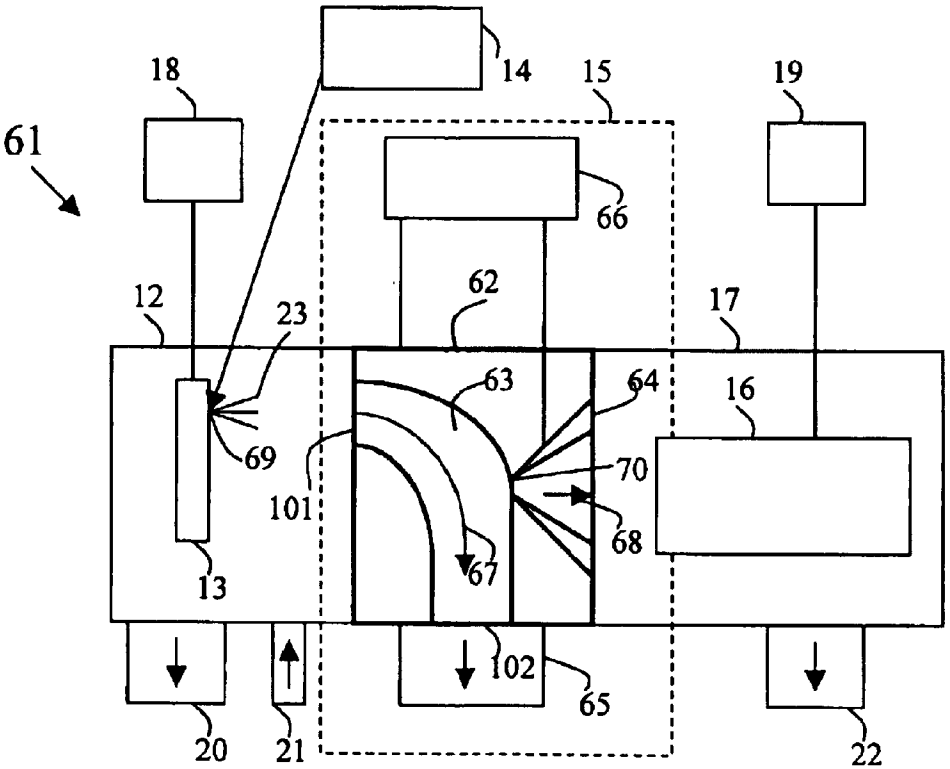
FIG. 5 is a schematic drawing illustrating one embodiment of an ion source according to one aspect of the invention, incorporating a bent flow.

Referring to FIG. 5, still another embodiment (called an 'S-path' herein) of an ion source 61 includes a protecting interface 15 that comprises a heated block 62 with a channel 63 having an input 101 and an output 102, a sampling cone 64 located on the side of the channel 63, a pump 65 operable to evacuate the far end of the channel 63, and set of DC power supplies 66 coupled to heated block 62 and the sampling cone 64. In this particular embodiment, the channel 63 has a single bend, but other shapes or forms can be utilized.

In operation, the gas is fed through a gas supply 21 and is evacuated by the pump 65 from the sample chamber 12 via channel 63. The gas flow path is shown by an arrow 67. A small portion 68 of the gas flow 67 flows through the sampling aperture 70 of the sampling cone 64. The pumping speed of the pump 65 and the flow of gas supplied by supply 21 can be adjusted to provide gas pressure P in the sample chamber around 1 torr. The dimensions of the channel—i.e., diameter D and bent radii R—can be selected to provide P*D~P*R>2 cm*torr, such that gas flow will entrain analyte ions, matrix vapors, small clusters, and other such particles and carry them through the bent channel 63. To reduce diffusion of ions onto walls of the channel 63, the channel 63 is as short as possible, within constrains of diameter D being comparable with bent radii R. A requirement of P*D>2 cm*torr is equivalent to $D/\lambda>30$. Thus, diffusion boundary layers merge at about $D*\mathrm{sqrt}(D/\lambda)\sim 5$ D from the entrance into the channel, i.e. a channel of length=2 D should retain a core of undisturbed ion flow. Analyte ions of interest are extracted from the flow by an electric field through the sampling aperture 70 in the sampling cone 64 and into an ion optics 16. The strength of the extracting DC electric field is controlled by power supplies 66 and can be adjusted to extract analyte ions of the mass range of interest. To reduce entraining of matrix vapors and other such contaminating particles into the flow 68, the diameter d of the sampling aperture 70 can be selected well below D, so that P*d<1 cm*torr. The small size of the sampling aperture 70 does not reduce analyte ion extraction, since the electric field is focused on the tip of the cone and improves analyte ion extraction as well as mass range of extracted analyte ions.

Bent channel 63 is employed to protect the ion optics 16 and consequently the mass analyzer from large matrix clusters, which can be emitted from the illuminated portion 69 of the sample plate 13. Large size clusters can also get into the entrance of the channel 63, located in front of the spot 69. However, the shortest travel path between the illuminated portion 69 of the sample plate 13 and the sampling aperture 70 is substantially obstructed, for example by the wall of the bent channel 63. The large size clusters cannot follow the flow bend and precipitate on the channel walls. Eventually, those clusters evaporate from hot walls and are carried away by the gas flow 67.

Figure 6:
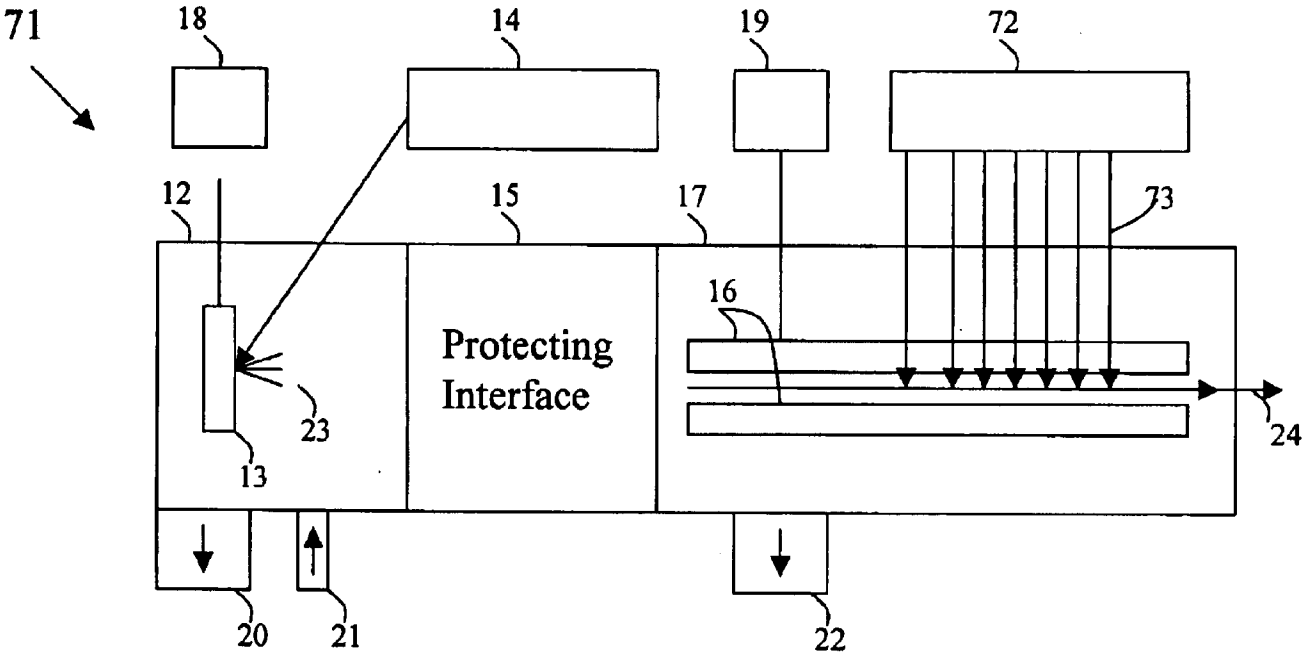
FIG. 6 is a schematic drawing illustrating an embodiment of an ion source according to one aspect of the invention incorporating UV light for ion declustering.

Referring to FIG. 6, the matrix-protected MALDI ion sources described above can include an additional source 72 of UV light illuminating ion flow on the axis of ion optics 16.

In operation, gas pressure in the sample chamber 12 as well as gas pressure in the matrix-protecting interface 15 can be adjusted in the range from 3 to 10 torr. The product P*L is increased to approximately 10 cm*torr. The dense gas flow of the matrix-protecting interface is capable of entraining larger particles, such as clusters of matrix, including up to $10^6$ molecules. This provides additional protection against particles that can possibly be formed in a MALDI plume. It is known that gas pressure above 1 torr rapidly promotes formation of ion clusters. This problem can be addressed by introducing UV light in the range of wavelength from 300 to 350 nm, formed, for example, by a nitrogen bulb with a filter and a reflecting mirror, focusing UV light on the axis of the ion guide. Matrix molecules selectively absorb the UV light of those wavelengths, while peptide and protein ions remain transparent. Such selective excitation can lead to excitation of matrix molecules and their evaporation from ion clusters. Minor excitation of internal energy, vibrationally transferred to analyte ions from hot matrix molecules should be rapidly relaxed in gas collisions in the ion guide, filled with gas at 0.1 to 10 torr, depending on the type of interface. The effect of collisional cooling is similar to that in a MALDI ion source operating at intermediate gas pressure. Once matrix molecules evaporate, they have only a small probability to stick to analyte ions again. Note that concentration of evaporated matrix molecules in the ion optics is estimated to be at least ten orders of magnitude lower than in the laser plume, where clusters have been formed. Thus, this use of UV light can provide improved matrix protection and cooling of analyte ions at lower gas pressures.

Figure 7:
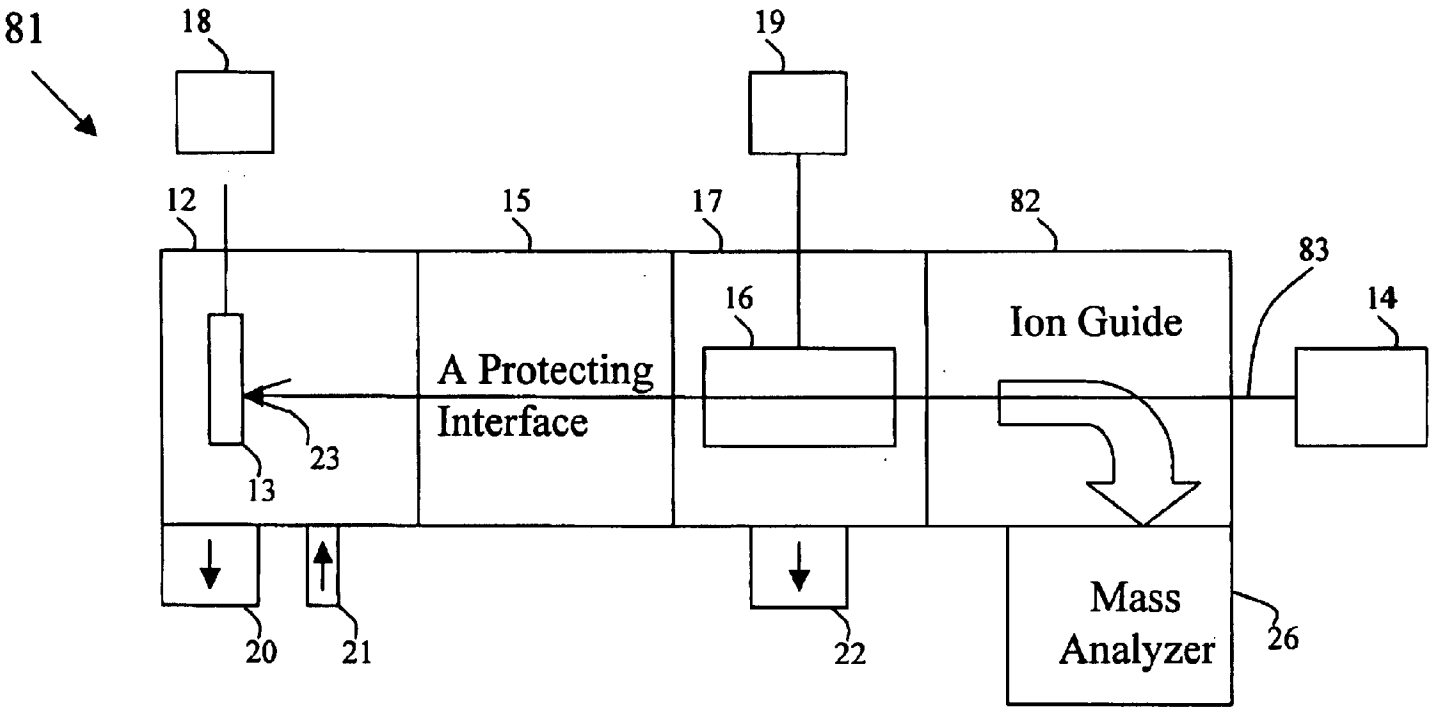
FIG. 7 is a schematic drawing illustrating one embodiment of an ion source according to one aspect of the invention, incorporating a coaxial introduction of a laser beam.

Referring to FIG. 7, the methods and ion sources of the invention, including the embodiments described above, can be adapted to use a laser 14 as a source of UV light for matrix declustering. As shown, one embodiment of an ion source 81 includes additional ion optics 82 with a bent path. The laser beam 83 of the laser 14 is introduced along the axis of the first ion optics 16.

In operation, the sample chamber 12 is also filled with gas to pressure of 3 to 10 torr, improving ion cooling and protection against matrix clusters. Ion clusters, which are transported in the ion optics 16 and known to be confined near the main axis of the ion optics 16, are illuminated by parallel laser beam of about 0.5 mm size. The MALDI ion source is known to operate efficiently with a wide defocused laser beam with a size up to 1 mm, as long as the energy density remains about 100 $mJ/mm^2$ per pulse for most matrices. Thus, a laser with energy of about 25 $\mu$J/pulse, available from laser manufacturers, suits such a task. At kilohertz range of laser repetition rate and for typical ion transport time (e.g., in the order of ~100 ms for a 30 cm long guide), every matrix molecule in ion clusters has a high probability of selectively absorbing UV light and being removed from the ion with a minor excitation of ion internal energy. Fairly high gas pressure in the RF ion guide from 0.1 to 1 torr provides for collisional cooling of ion internal energy. The amount of matrix material removed from clusters is many orders of magnitude lower compared to matrix material emitted from the sample and implies no danger for interface contamination.

The methods and apparatus described herein can be applied to any type of mass analyzers, including tandem mass spectrometers, and can employ various ion transport interfaces, adapting the source to a mass spectrometer. Appropriate mass analyzers include, for example, linear ion trap (LIT), orthogonal acceleration time-of-flight mass spectrometers (oa-TOF MS), orbitrap, and tandems such as LIT-oa-TOF MS and quadrupole-oa-TOF MS. In one example, the ion optics includes at least one an additional stage of the RF ion guide, such as a quadrupole RF ion guide.

A number of embodiments of the invention have been described. Nevertheless, it will be understood that various modifications may be made without departing from the spirit and scope of the invention. The steps of the methods illustrated and described above can be performed in a different order and still achieve desirable results. The disclosed apparatus, methods, and example are illustrative only and not intending to be limiting. The apparatus illustrated and described can include other components in addition to those explicitly described, which may be required for certain applications. The various features explained on the basis of the various exemplary embodiments can be combined to form further embodiments of the invention. Accordingly, other embodiments are within the scope of the following claims.

What is claimed is:

1. An ion source for providing and transporting analyte ions derived from a sample to ion optics having a main axis, the ion source comprising:

a sample chamber configured to receive a sample plate supporting a sample, the sample comprising at least an analyte and a matrix;

an illumination source configured to illuminate at least a portion of the sample on the sample plate to generate analyte ions and particles;

a matrix-protecting interface located between the sample plate and the ion optics, the matrix-protecting interface having a sampling aperture and being configured such that the shortest travel path between the illuminated portion of the sample plate and the sampling aperture is substantially obstructed.

2. An ion source according to claim 1, further comprising:

a gas supply providing a gas flow for influencing particles generated by the action of the illumination source away from the sampling aperture.

3. An ion source according to claim 2, wherein:

the gas supply provides for a flow of gas in a direction substantially orthogonal to the main axis of the ion optics.

4. An ion source according to claim 2, wherein;

the gas supply provides for a flow of gas is in a direction that is not parallel to the main axis of the ion optics.

5. An ion source according to claim 1, wherein the matrix-protecting interface comprises:

a block defining a channel.

6. An ion source according to claim 5, wherein:

the sampling aperture is disposed along a length of the channel.

7. An ion source according to claim 6, further comprising:

a voltage source coupled to the block to provide potentials sufficient to extract analyte ions of interest from the channel.

8. An ion source according to claim 5, wherein:

the channel receives analyte ions and particles in a first ratio of analyte ions to particles, and the sampling aperture transfers a portion of the analyte ions and particles to the ion optics in a second ratio of analyte ions to particles, the second ratio being greater than the first ratio.

9. An ion source according to claim 5, wherein the channel further comprises:

an input and an output for analyte ions of interest.

10. An ion source according to claim 9, wherein:

a ratio of analyte ions to particles exiting the channel via the output is greater than a ratio of analyte ions to particles entering the channel via the input.

11. An ion source according to claim 9, further comprising:

a pump configured to evacuate the channel at the output.

12. An ion source according to claim 1, wherein:

the gas pressure in the sample chamber is between 1 and 10 torr.

13. An ion source according to claim 12, wherein:

the sample chamber is pressurized with a gas at a pressure of approximately 1 torr.

14. An ion source according to claim 9, wherein:

the channel comprises at least one bend.

15. An ion source according to claim 14, wherein:

the bend comprises a first passage adjacent the input, a second passage adjacent the output, and wherein the first and second passages are coupled to one another and approximately orthogonal to each other.

16. An ion source according to claim 14, wherein:

a diameter D, length L, and radii of bend R of the bent channel are selected to satisfy the following conditions: $P*D>2$ cm*torr, $P*R>2$ cm*torr and $L/D<5$.

17. An ion source according to claim 1, wherein:

at least a portion of the matrix-protecting interface is heated.

18. An ion source according to claim 1, wherein:

the illumination source is a pulsed laser source.

19. An ion source according to claim 2, wherein:

a velocity of the gas flow is sustained below 100 m/s.

20. An ion source according to claim 1, wherein:

the ion optics comprises an ion guide.

21. An ion source according to claim 1, wherein:

the ion optics is a component of a mass analyzer.

22. An ion source according to claim 1, wherein:

the ion optics comprises a trapping-type mass analyzer.

23. An ion source for providing and transporting analyte ions derived from a sample to ion optics having a main axis, the ion source comprising:

a sample chamber configured to receive a sample plate supporting a sample, the sample comprising at least an analyte and a matrix;

an illumination source configured to illuminate at least a portion of the sample on the sample plate to generate analyte ions and particles; and a matrix-protecting interface located between the sample plate and the ion optics, the ion source being configured such that the shortest travel path between the illuminated portion of the sample plate and the input of the ion optics is substantially obstructed.

24. An ion source for providing and transporting analyte ions derived from a sample to ion optics having a main axis, the ion source comprising:

a sample chamber configured to receive a sample plate supporting a sample, the sample comprising at least one analyte and a matrix;

an illumination source configured to illuminate at least a portion of the sample on the sample plate to generate analyte ions and particles;

a matrix-protecting interface located between the sample plate and the ion optics, the matrix-protecting interface comprising:

a gas supply for influencing particles generated by the action of the illumination source away from the ion optics, the gas supply providing a component of gas flow that is directed at an angle x (ranging from zero to 90 degrees) relative to the main axis and directed away from the ion optics; and a voltage source to provide potentials sufficient to extract analyte ions of interest from the gas flow for transmission to the ion optics.

25. An ion source according to claim 24, wherein:

the angle x is about 90 degrees.

26. An ion source according to claim 24, wherein:

the angle x is greater than zero degrees.

27. An ion source according to claim 24, wherein:

the pressure in the sample chamber is between 1 and 10 torr.

28. An ion source according to claim 27, wherein:

the sample chamber is pressurized with a gas at a pressure of approximately 1 torr.

29. An ion source according to claim 24, wherein:

at least a portion of the matrix-protecting interface is heated.

30. An ion source according to claim 24, wherein:

the illumination source is a pulsed laser source.

31. An ion source according to claim 24, wherein:

a velocity of the component of gas flow is sustained below 100 m/s.

32. An ion source according to claim 24, wherein:

the ion optics comprises an ion guide.

33. An ion source according to claim 24, wherein:

the ion optics is a component of a mass analyzer.

34. An ion source according to claim 24, wherein:

the ion optics comprises a trapping type mass analyzer.

35. An ion source according to claim 24, wherein the matrix-protecting interface further comprises:

an annular electrode; and wherein the gas supply is configured to feed gas into the ion optics, thereby inducing gas counter flow to influence particles away from the ion optics.

36. An ion source according to claim 24, wherein the matrix-protecting interface further comprises:

a plurality of electrodes enclosing a curtain chamber, the electrodes having first and second apertures, the second aperture being smaller than the first aperture;

wherein:

the gas supply is configured to feed gas into the curtain chamber to create a counter flow through the first aperture towards the sample plate to influence particles away from the ion optics; and the voltage source is configured to focus the extracted ions into the second aperture for transport into the ion optics.

37. An ion source according to claim 24, wherein the matrix-protecting interface further comprises:

a tube located between the sample plate and the ion optics;

the gas supply configured to feed gas into the tube, thereby creating a gas flow parallel to the sample plate; and an electrode comprising a sampling aperture, the sampling aperture providing for communication between the sample chamber and the ion optics and being located downstream of the gas flow relative to the illuminated portion of the sample plate.

38. An ion source according to claim 24, wherein:

the ion source further comprises a source of UV light of wavelength from 300 to 360 nm configured to illuminate the ion path in any area with gas pressure above 0.1 torr to remove matrix molecules from cluster ions without fragmentation of analyte ions.

39. An ion source according to claim 24, wherein:

the gas pressure in the sample chamber is between 1 and 10 torr.

40. An ion source according to claim 24, wherein:

the gas pressure in the sample chamber is between 10 torr and 1 atmosphere.

41. An ion source according to claim 38, wherein:

the source of UV light is a nitrogen bulb with a filter and a focusing mirror.

42. An ion source according to claim 38, wherein:

the source of UV light is a laser used for ion generation in the MALDI ion source, the laser being configured to provide a beam introduced along the axis of the ion guide and onto the laser illuminated spot.

43. A method for generating and transporting analyte ions derived from a sample to ion optics, the method comprising:

illuminating at least a portion of a sample deposited within a matrix on a sample plate in a sample chamber with UV light to generate analyte ions and particles;

transporting the analyte ions and particles to a matrix-protecting interface located between the sample plate and the ion optics, the matrix protecting interface comprising a channel for a gas flow and a sampling aperture, the channel configured such that a shortest travel path between the illuminated portion of the sample on the sample plate and the sampling aperture is substantially obstructed; and extracting analyte ions of interest from the gas flow with a voltage source and transmitting the analyte ions through the sampling aperture to the ion optics.

44. The method of claim 43, wherein:

gas pressure in the sample chamber is adjusted around 1 torr to improve ion collisional cooling without excessive formation of cluster ions.

45. The method of claim 43, wherein:

the gas pressure in the sample chamber is adjusted around 10 torr and cluster ions are fragmented by a selectively absorbed UV light.

46. The method of claim 43, further comprising:

applying heat to at least a portion of the matrix-protecting interface.

47. The method of claim 43, further comprising:

sustaining the velocity of the gas flow below 100 m/s.

48. A mass spectrometer comprising:

an ion source of any of claim 1, 5 or 24; and a mass analyzer.

49. The mass spectrometer of claim 48; wherein:

the mass analyzer is selected from the group consisting of orthogonal time-of-flight (oa-TOF), ion trap (IT), linear ion trap (LIT), orbitrap, FTMS, ion cyclotron resonance (ICR), quadrupole/oa-TOF, LIT-TOF, LIT-oa-TOF, LIT-orbitrap, LIT-ICR, Quadrupole-ICR, and IT-ICR.

50. A method for generating and transporting analyte ions derived from a sample to ion optics, the ion optics having a main axis, the method comprising:

illuminating at least a portion of a sample deposited within a matrix on a sample plate in a sample chamber with UV light to generate analyte ions and particles;

transporting the analyte ions and particles to a matrix-protecting interface located between the sample plate and the ion optics;

influencing particles generated by illumination step away from the ion optics with a gas supply providing at least one component of gas flow that is directed at an angle x (ranging from zero to 90 degrees) relative to the main axis and directed away from the ion optics; and extracting analyte ions of interest from the gas flow with a voltage source and transmitting the analyte ions to the ion optics.

* * * * *